US008840534B2

(12) United States Patent
Rapparini

(10) Patent No.: US 8,840,534 B2
(45) Date of Patent: Sep. 23, 2014

(54) BAG PACKAGING CAROUSEL HAVING INTERMITTENT VERTICAL SPINDLES

(75) Inventor: Gino Rapparini, Bologna (IT)

(73) Assignee: ICA S.p.A., Bologna (IT)

( * ) Notice: Subject to any disclaimer, the term of this patent is extended or adjusted under 35 U.S.C. 154(b) by 648 days.

(21) Appl. No.: 13/014,018

(22) Filed: Jan. 26, 2011

(65) Prior Publication Data

US 2011/0209440 A1 Sep. 1, 2011

(30) Foreign Application Priority Data

Jan. 27, 2010 (IT) ..... 2010A0049

(51) Int. Cl.

| | |
|---|---|
| ***B31B 1/32*** | (2006.01) |
| ***B65B 1/02*** | (2006.01) |
| ***B65B 3/02*** | (2006.01) |
| ***B31B 29/00*** | (2006.01) |
| ***B31B 3/00*** | (2006.01) |
| ***B31B 19/92*** | (2006.01) |

(52) U.S. Cl.

CPC . *B31B 29/00* (2013.01); *B31B 1/32* (2013.01); *B65B 1/02* (2013.01); *B31B 2219/2618* (2013.01); *B31B 3/00* (2013.01); *B31B 19/92* (2013.01); *B31B 2201/262* (2013.01); *B31B 2219/028* (2013.01); *B31B 2219/92* (2013.01); *B31B 2221/20* (2013.01); *B31B 2221/40* (2013.01); *B65B 3/025* (2013.01)

USPC ..... 493/163; 493/175; 493/250; 493/252

(58) Field of Classification Search

CPC ..... B31B 1/28–1/32; B31B 2219/028; B31B 2219/2609; B31B 2219/2618; B31B 2219/929; B65B 1/02; B65B 3/025

USPC ..... 493/184, 452, 163, 175, 250, 252; 53/452, 457, 458, 558, 563–565

See application file for complete search history.

(56) References Cited

U.S. PATENT DOCUMENTS

| | | | | |
|---|---|---|---|---|
| 3,120,089 | A * | 2/1964 | Egleston et al. | 53/565 |
| 3,699,743 | A | 10/1972 | King et al. | 53/186 |
| 4,590,740 | A * | 5/1986 | Rodocker | 53/426 |
| 4,604,850 | A * | 8/1986 | Reil | 53/423 |
| 4,845,927 | A * | 7/1989 | Rapparini | 53/511 |
| 5,027,585 | A * | 7/1991 | Russell | 53/458 |
| 6,101,786 | A | 8/2000 | Lees | 53/167 |
| 2004/0206052 | A1 * | 10/2004 | Shean et al. | 53/456 |

FOREIGN PATENT DOCUMENTS

| | | |
|---|---|---|
| EP | 0131 101 | 1/1985 |
| GB | 881 | 0/1911 |

* cited by examiner

*Primary Examiner* — Stephen F Gerrity

(74) *Attorney, Agent, or Firm* — Fattibene and Fattibene LLC; Paul A. Fattibene

(57) ABSTRACT

Bag packaging machine comprising an intermittent carousel having vertical spindles (M) fastened to the horizontal carousel (G) and facing upwards allowing the realization of bags (S) with the opening facing downwards and the bottom facing upwards and a collecting device adapted to collect the bags (S) from the spindles (M) and to reverse them so as to place them with the opening facing upwards and the bottom facing downwards so as to be able to fill them. For example, the collecting device may comprise a belt (N) in continuous transit, to which holding devices (V), such as for instance suction cups, are connected.

20 Claims, 13 Drawing Sheets

BAG PACKAGING CAROUSEL HAVING INTERMITTENT VERTICAL SPINDLES

FIELD OF THE INVENTION

The present invention relates to the technical field of the construction of machines for packaging bags starting from a reel. In particular, the present invention relates to packaging machines having vertical spindles.

STATE OF THE ART

In the prior art, several international patents of the applicant are known deriving from the Italian patent applications BO 1983 A003491 and BO 1987 A003326. For example, the European Patent EP0131101B1 of the applicant is known in the prior art.

In both the Italian documents cited above and in the European Patent, it is possible to notice the presence of an intermittent horizontal carousel equipped with vertical spindles placed from top to bottom, around which a sheet is wound so as to form bags exhibiting the opening facing upwards. The presence of spindles placed from top to bottom and accordingly placed below the horizontal carousel implies a limited accessibility to the space surrounding the spindles. In particular, since the spindles are placed below the carousel, they are placed in correspondence to other structural components of the machine so that the space surrounding the spindles is limited. This renders not only the accessibility of the operator to the spindles more difficult, but it sets also constraints on the dimensions and/or on the position of the components of the machine which cooperate with the spindles.

Document GB191000881A describes a machine for making block bottom paper bags. The system described in GB191000881A comprises a disc placed in a vertical plane and accordingly adapted to revolve intermittently around a horizontal axis. The disc is provided with horizontal formers on which the bags are formed. The system is further provided with a device for removing the bags from the formers. In particular, the device comprises two parallel pallets 195 and 196 adapted to fit against the sides of the formers. Each of the pallets has a thin rebated front edge 197 and a height such that the inclined edge 197 enters the open end of the bag so as to push it. The pallets 195 and 196 allow therefore pushing the bag from the former along the horizontal direction and bringing it into the folding box where the sides of the bag are folded longitudinally and the bag collapsed. The system with the pallets performs therefore an alternate motion slipping the bag completely off the former during a single halt of the disc. In this way, the risk of breaking the bag during the removal is high. Moreover, the system described in GB191000881 has a complex structure. Furthermore, it can be operated at very low production speed since the parallel pallets system allows the transport of a bag at a time. Moreover, the bags removed by means of the parallel pallets are directed along the horizontal direction towards the box inside which they are collapsed. Accordingly, this box has to be placed in correspondence of the former limiting the accessibility spaces around the former itself.

The present invention relates to functional improvements optimizing the systems known from the prior art. In particular, the present invention provides for the presence of vertical spindles, attached to an intermittent horizontal carousel, but placed from bottom to top so as to simplify and facilitate the formation of the closed bottom of the bag.

SUMMARY OF THE INVENTION

The present invention relates to a bag packaging machine with intermittent carousel having vertical spindles. In particular, the present invention is based on the idea of providing the packaging machine with vertical spindles fastened to the horizontal carousel and facing upwards so as to allow the formation of bags having the opening facing downwards and the bottom facing upwards and with collecting means adapted to collect the bags from the spindles and to reverse them so as to place them in a position adapted to perform the filling of the bags themselves.

The structure with the vertical spindles facing upwards and with the collecting means operating with said spindles allows the realization of an extremely functional design of the machine. In particular, since all the structural components of the machine are placed below the carousel, the space surrounding the spindles is wide so that there are no particular constraints for the dimensions and/or for the positioning of further components of the machine.

Furthermore, the accessibility to the region in correspondence of the spindles is improved so that for instance maintenance operations are rendered more quick and easy. The system allows therefore the obtainment of a large number of bags that are not only structured in such a way so as to be able to be filled, but they are also placed in a position suitable for the filling. This facilitates the filling operations and allows further quickening the production times.

According to a first embodiment of the present invention, a packaging machine with intermittent carousel having vertical spindles is provided, comprising vertical spindles fastened to the horizontal carousel and facing upwards so as to allow the realization of bags having the opening facing downwards and the bottom facing upwards and collecting means adapted to collect the bags from the spindles and to reverse the bags so as to place them with the opening facing upwards and the bottom facing downwards so as to be able to perform the filling of the bags.

According to a further embodiment of the present invention, a bag packaging machine is provided, wherein the collecting means are adapted to simultaneously support a plurality of bags so that at least some of the supported bags are simultaneously in different phases of the reversing operation. In this way both the support and the reversing of several bags are performed, thus quickening the production times. Furthermore, it is thus possible to perform simultaneously the reversing and the transfer of several bags from the carousel comprising the spindles to the subsequent stations provided for the bags.

According to a further embodiment of the present invention, a bag packaging machine is provided, wherein the collecting means comprise a belt in continuous transit whose motion is synchronized with the motion of the carousel, the belt comprising holding means adapted to support the bags. The presence of the belt with the holding means in continuous transit and with a motion synchronized with the motion of the carousel allows the noticeable increase of the number of bags that can be removed from the spindle and thus the quickening of the production times.

According to a further embodiment of the present invention, a bag packaging machine is provided wherein the holding means comprise suction cups, the suction cups being in communication with a suction pump. The suction cups allow the efficient and easy holding of the bags. Furthermore, the suction cups are particularly suitable for avoiding damages in the bags as a consequence of the holding. The suction pump allows the precise control of the force of the grip and the adjustment of the grip to different kinds of materials the bags might be made of and, accordingly, to different stiffness of the bags themselves.

According to a further embodiment of the present invention, a bag packaging machine is provided, wherein the collecting means further comprise releasing means adapted to release the bags placed with the opening facing upwards and the bottom facing downwards from the collecting means. In this way the bags are released by the collecting means without intervention of further external components of the machine.

According to a further embodiment of the present invention, a bag packaging machine is provided wherein the releasing means comprise a nozzle adapted to produce an air blow inside the bags placed with the opening facing upwards and the bottom facing downwards so as to remove the bags from the collecting means. The air blow allows the effective removal of the bags from the collecting means minimizing at the same time the risk of damaging them during this operation.

According to a further embodiment of the present invention, a bag packaging machine is provided wherein the releasing means comprise means for alternately connecting the suction cups to the suction pump or to the atmospheric pressure. In this way, the holding and releasing actions of the suction cups can be controlled with precision in an easy way.

According to a further embodiment of the present invention, a bag packaging machine is provided further comprising conveying means adapted to convey the bags placed with the opening facing upwards and the bottom facing downwards, the collecting means being adapted to transfer the bags from the carousel to the conveying means during the reversing procedure. The conveying means can be for instance adapted to convey the bags to a filling station. The reversing of the bags during the transfer from the carousel to the conveying means allows the acceleration of the production times and the increase of the productivity of the machine.

According to a further embodiment of the present invention, a bag packaging machine is provided wherein a shaft runs along the vertical direction inside the hollow spindles so that the upward motion of the shaft allows removing upwards at least partially the bags formed on the spindles. This allows making the removal of the bags easier by means of components integrated inside the spindles and, thus, not occupying the space around the spindles. Furthermore, in this way, the bags are removed at least partially from the spindles by means of components acting on the inside of the bags themselves minimizing the risk of damaging the bags. In particular, when the bag is formed on the spindle, it strongly adheres to the spindle. Removing at least partially the bag from this position by means of the shafts sliding inside the hollow spindles and thus substantially pushing the inner side of the bottom of the bag, allows minimizing the risk of damaging the bag and thus removing it in a fast and efficient way.

According to a further embodiment of the present invention, a bag packaging machine is provided, wherein the vertical motion of the shaft is actuated by means of a shaped groove placed on the fixed cam of the carousel so that the shaft runs along the vertical direction as a consequence of the rotation of the carousel. This allows automatically actuating the vertical motion of the shaft upwards and downwards by means of the rotation of the carousel. In particular, therefore, specific actuation means for the motion of the shafts are not required since the rotation of the carousel around the fixed cam provided with the shaped groove along which the extremity of the shafts is constrained causes the automatic lift and fall of the shafts.

According to a further embodiment of the present invention, a bag packaging machine is provided, wherein the upper portion of the shaft is provided with a support comprising a first surface horizontal and adapted to support the bottom of the bags and a second surface vertical and adapted to cooperate with the collecting means in the collecting phase of the bags from the spindles. The support allows the further simplification of the removal of the bags from the spindles minimizing the risk of breaking them. In particular, the first surface which is horizontal is adapted to support the bottom of the bags allowing the application of a homogeneous pressure distributed on the bottom of the bags so as to reduce the risk of damaging it during the removal. The second surface which is vertical provides for example an effective contrast to the collecting means allowing the collecting means to apply a pressure on the side wall of the bags reducing the risk of breaking them and, at the same time, holding them in an effective way.

According to a further embodiment of the present invention, a bag packaging machine is provided, wherein the collecting means are adapted to collect the bags from the spindles when the shaft is placed in the uppermost position of its travel range. In this way, the collecting means operate on the bags when the shaft is at the uppermost end of the travel range and, thus, when the bags are substantially removed from the spindles. The risk of damaging the bags is accordingly further reduced. Furthermore, the time for removing the bags from the spindles is noticeably quickened since the collecting means operate when the bags are almost completely removed from the spindle by means of the shaft.

According to a further embodiment of the present invention, a bag packaging machine is provided, further comprising means for placing the unfolded sheet, which is cut from a feeding reel and properly provided with cuts, with the upper side above the upper surface of the winding spindle so as to allow the formation of the bottom of the bag. The cut may be performed for instance by means of cutters. The formation of cuts adapted to define the flaps of the bottom of the bag may be performed by means of cutters or others cutting means.

According to a further embodiment of the present invention, a bag packaging machine is provided, further comprising folding devices for the four flaps of the bottom of the bag, the folding devices being placed so as to be in correspondence of at least one of the spindles so that a first folding device and a second folding device are opposed with respect to the spindle along the radial direction of the carousel and so that a third folding device and a fourth folding device are opposed with respect to the spindle along a direction substantially perpendicular with respect to the direction defined by the first folding device and the second folding device. The presence of the folding devices properly placed with respect to the spindle allows the efficient formation of the bottom of the bags.

According to a further embodiment of the present invention, a bag packaging machine is provided, further comprising one or more vertical press devices placed above the vertical of the spindles, the vertical press devices being adapted to stabilize the bottom of the bags contrasting with the upper surface of the spindles.

According to a further embodiment of the present invention, a bag packaging machine is provided, further comprising an upper fixed plate placed above the spindles along at least a portion of the perimeter of the carousel so as to stabilize the bottom of the bags during the rotation of the carousel. In this way, the risk that the ready formed bottom of the bags opens itself during the rotation of the spindles is minimized. Moreover, the presence of the plate placed above the spindles prolongs the duration of the pressure on the bottom of the bags simultaneously allowing the carousel to rotate. In this way, the production of bags can be accelerated and the productivity of the machine can be increased guaranteeing the same time the stability of the bottom of the bags.

According to a further embodiment of the present invention, a bag packaging machine is provided, wherein the fixed plate comprises openings corresponding to the upper portion of the spindles, each of the openings being adapted to house at least one of the vertical press devices so as to stabilize the bottom of the bags placed on the spindles in correspondence to the openings. In this way, the stabilization action on the bags by means of the fixed plate is alternated with the stabilization action by means of the vertical press devices thus improving the stability of the bottom of the bags.

BRIEF DESCRIPTION OF THE FIGURES

The present invention is described with reference to the enclosed figures wherein the same reference signs (numbers and/or letters) relate to the same parts and/or similar parts of the system. In the figures.

DETAILED DESCRIPTION

In the following, the present invention is described with reference to particular embodiments as shown in the enclosed figures. Nevertheless, the present invention is not limited to the particular embodiments described in the following detailed description and shown in the figures, but rather the described embodiments simply exemplify several aspects of the present invention, the scope of which is defined by the claims.

Further modifications and variations of the present invention will be clear for the person skilled in the art. The present description has therefore to be considered as comprising all said modifications and/or variations of the present invention, the scope of which is defined by the claims.

Figure 1:
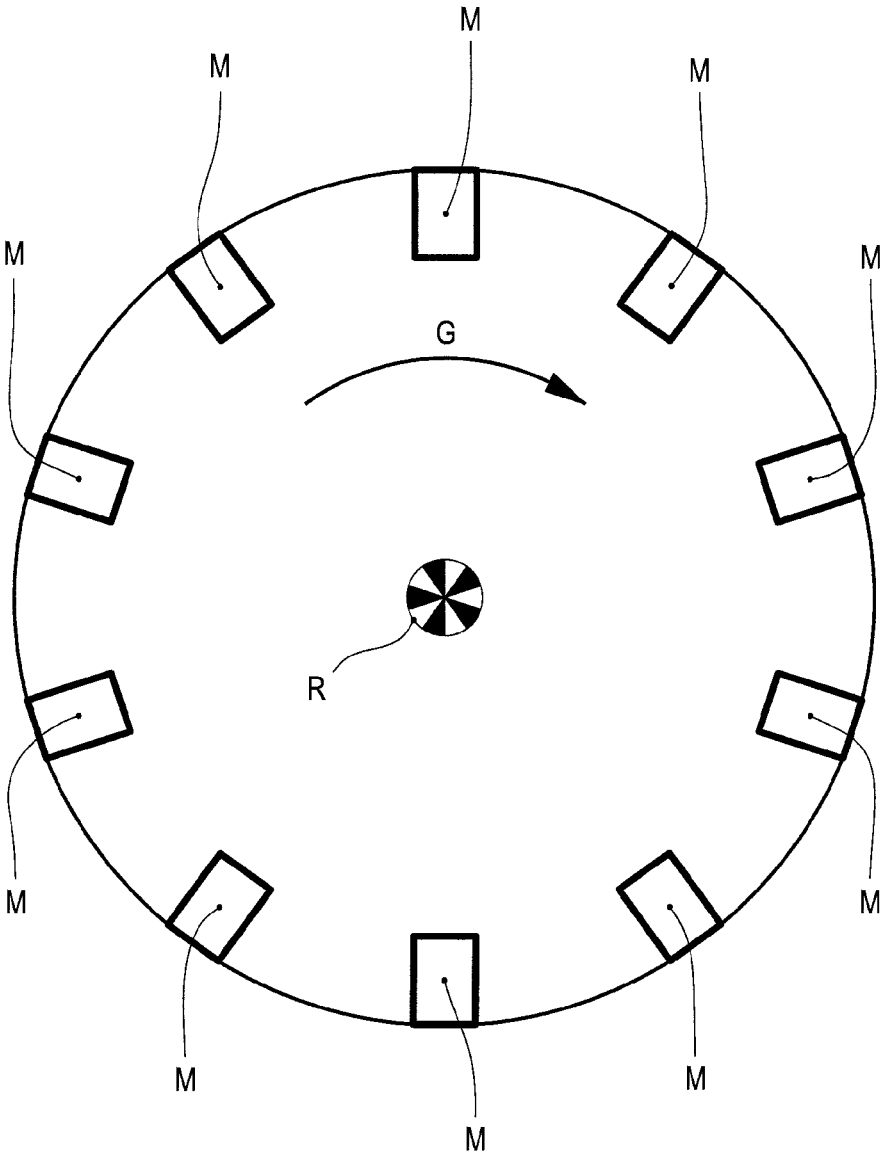
FIG. 1 schematically displays a plan view of a horizontal carousel provided with vertical spindles according to an embodiment of the present invention.

FIG. 1 schematically displays a plan view of a horizontal intermittent carousel G with center R and provided with ten vertical spindles M facing upwards. According to the present invention the number of spindles M the carousel is provided with is not limited to ten. The carousel G shown in FIG. 1 has a circular shape and the spindles are placed along the perimeter of the circumference.

Figure 2:
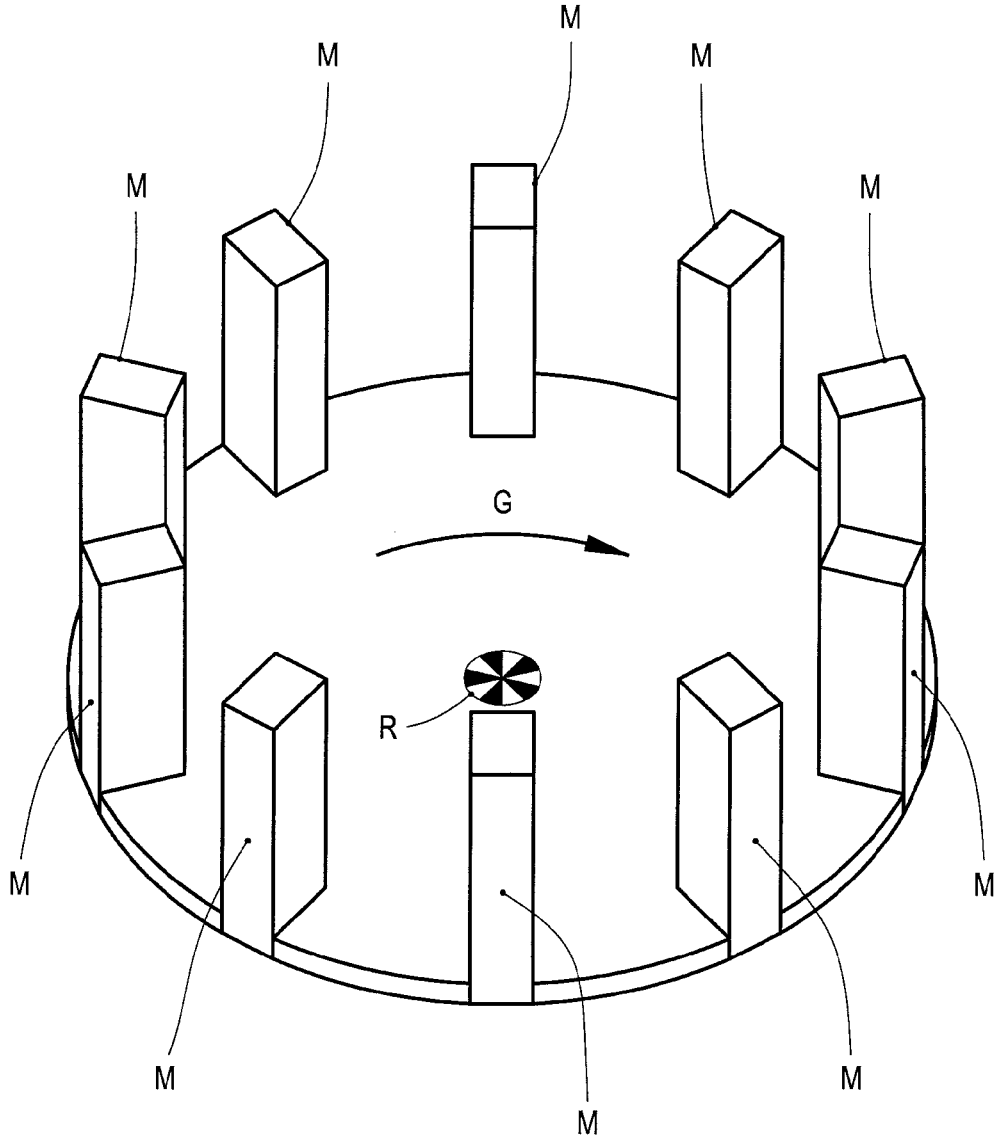
FIG. 2 schematically displays a three-dimensional axonometric projection of the carousel shown in FIG. 1.

FIG. 2 displays the carousel G of FIG. 1 in a three-dimensional axonometric projection. In FIG. 2 it is possible to see that the vertical spindles M facing upwards have a rectangular horizontal cross-section and are oriented with the long side of the rectangle radial to the center R of the carousel G. In this way, it is possible to arrange a higher number of spindles on a carousel with a predefined overall diameter.

Figure 3:
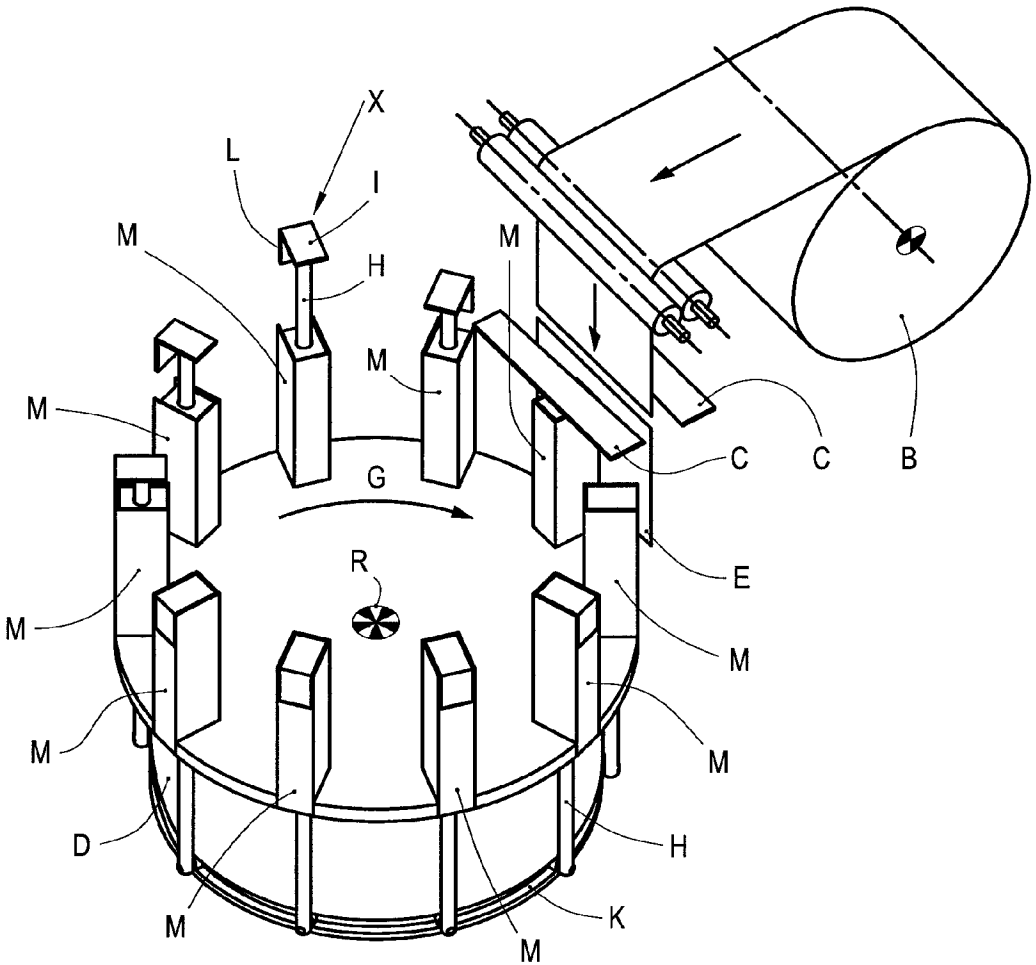
FIG. 3 schematically displays a carousel during operation and a feeding reel in correspondence to a spindle of the carousel according to an embodiment of the present invention.

FIG. 3 displays the positioning of a reel B from which the sheets E are cut so as to form the bags S by folding the sheets around the vertical spindles M oriented from bottom to top. The sheets are cut by means of cutters C. In particular, in the embodiment shown in FIG. 3, two parallel cutters C placed above a spindle in correspondence of same are shown. It is possible to notice that the arrangement of the spindles facing upwards renders the placement of the cutters easy since the space around the spindles is free from structural components of the machine.

Figure 4:
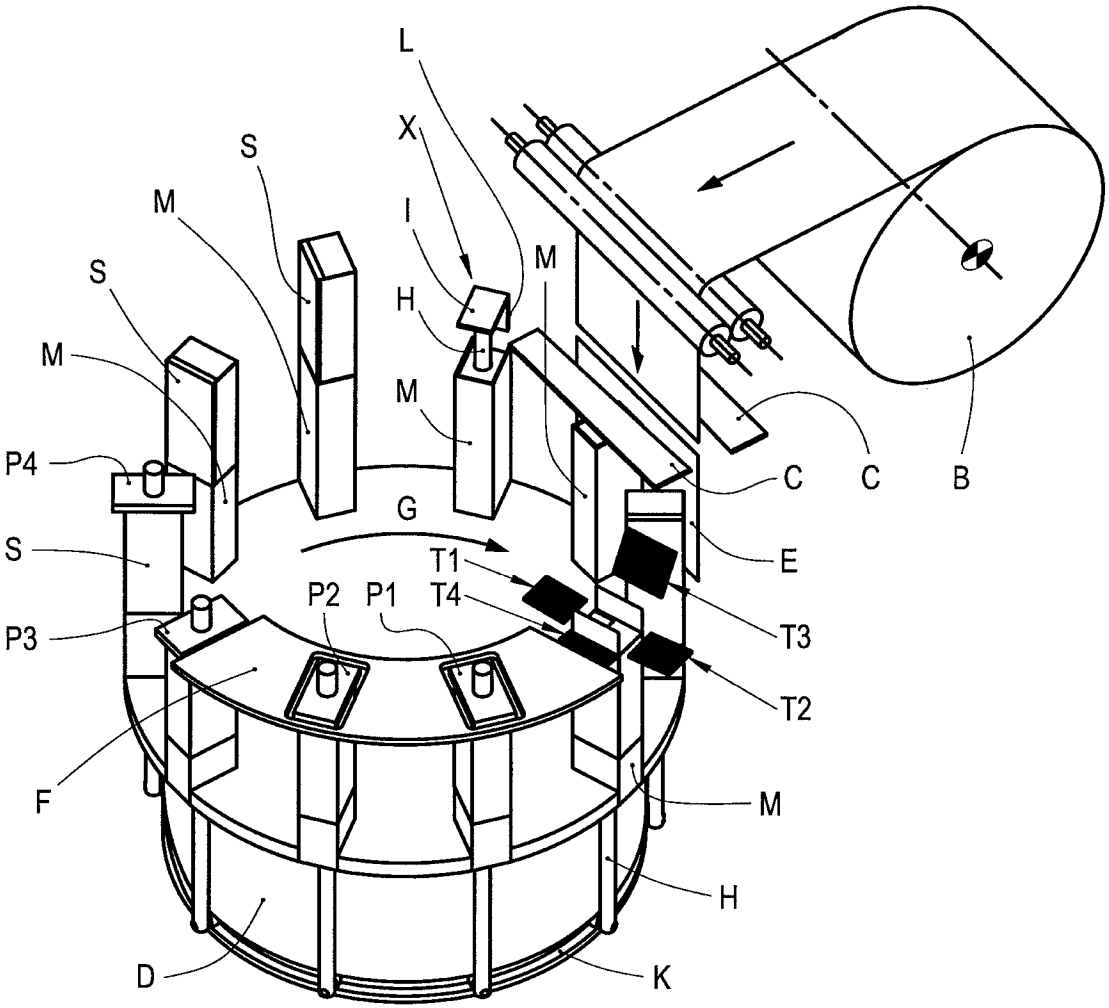
FIG. 4 schematically displays a carousel during operation with folding devices and vertical press devices according to an embodiment of the present invention.

FIG. 4 schematically displays the intervention of folding devices T1, T2, T3, T4 actuating the formation of the bottom of the bag S. The folding devices T1, T2, T3, T4 may for instance comprise movable slices. The folding devices T1, T2, T3, T4 are placed so as to be in correspondence of at least one of the spindles during the intermittent rotation of the carousel. In the embodiment shown in FIG. 4, four folding devices T1, T2, T3, T4 are present so as to form the bottom of the bags with four flaps. In particular, a first folding device T1 and a second folding device T2 are opposed with respect to the spindle M along the radial direction of the carousel G. In other words, the spindle is placed between the first folding device T1 and the second folding device T2. The first folding device T1 and the second folding device T2 are placed along the radial direction of the carousel G. A third folding device T3 and a fourth folding device T4 are opposed with respect to the spindle along a direction perpendicular to the direction defined by the first folding device T1 and the second folding device T2. In other words, the third folding device T3 and the fourth folding device T4 are placed along a direction substantially perpendicular to the radial direction of the carousel G. In case the spindles have a rectangular horizontal cross section with the long side placed along the radial direction of the carousel as schematically shown in FIG. 4, the first folding device T1 and the second folding device T2 act on the short sides of the rectangle, while the third folding device T3 and the fourth folding device T4 act on the long sides of the rectangle.

The folding devices T1, T2, T3, T3 are placed at a height slightly higher with respect to the height of the spindles so as to be able to slide above the upper surface of the spindles and to fold the bottom of the bags S. In particular, the sheet E may be properly provided with cuts J (see for instance FIG. 6) so as to form the flaps of the bottom of the bag. The sheet E can be placed with the upper side above the upper surface of the folding spindle so as to be able to perform the formation of the bottom of the bag. The parts of the sheet E protruding above the upper surface of the spindle are folded by the folding devices T1, T2, T3, T4 so as to form the bottom of the bag.

The system shown in FIG. 4 further comprises a fixed upper plate F placed above the spindles so as to stabilize the bottom of the bags S formed by the folding devices T1, T2, T3, T4 during the rotation of the carousel G. The fixed plate F has a curved shape and may occupy several portions of the circumference of the carousel G. For example, the fixed plate F may occupy an arc corresponding to an angle of approximately 90°. Alternatively, the fixed plate F may occupy arcs corresponding to angles which are greater or less than 90°.

During the rotation the carousel G, the spindles on which the bags S are formed with a bottom by means of the folding devices T1, T2, T3, T4 run under the fixed plate F. In this way, during the rotation of the carousel G, the bottom of the bags is stabilized by the action of the fixed plate F. In particular, the fixed plate F prevents the flaps of the bottom of the bags from lifting up again after they have been folded by the folding devices T1, T2, T3, T4.

In the system shown in FIG. 4, the upper fixed plate F is provided with special openings corresponding to the upper portion of the spindles M. In particular, in FIG. 4, the plate F occupies an arc of the carousel comprising two spindles M and comprises therefore two openings in correspondence to the two spindles M. Each of the openings is adapted to house a vertical press device. In particular, an opening houses the vertical press device P1 and the other opening houses the vertical press device P2.

The vertical press devices P1 and P2 are placed above the vertical of the spindles and are adapted to stabilize the bottom of the bags S contrasting with the upper surface of the spindles M.

Moreover, the system further comprises two vertical press devices P3 and P4 external to the fixed plate F. The vertical press devices P3 and P4 further stabilize the bottom of the bags S contrasting with the upper surface of the spindles M.

Figure 5:
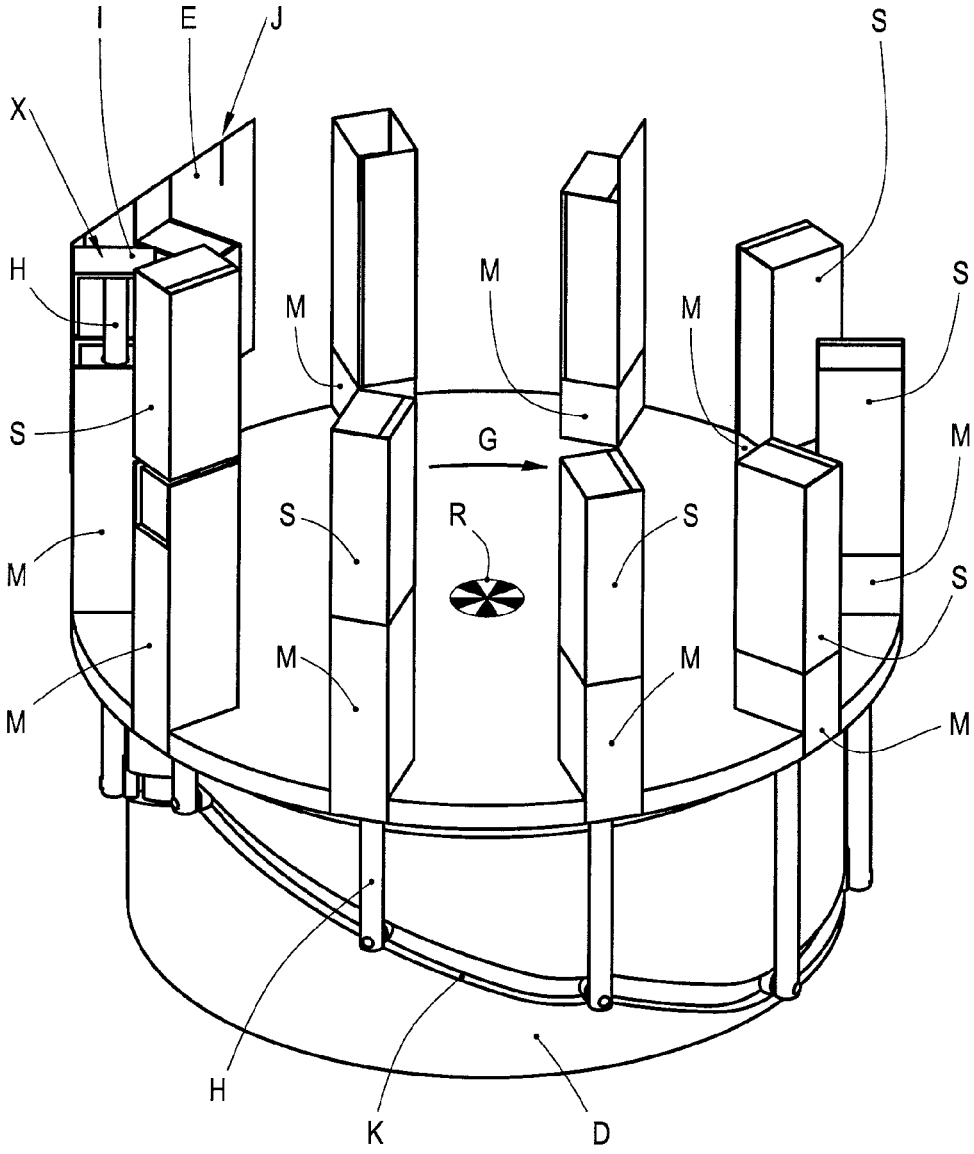
FIG. 5 schematically displays several phases of the formation and removal of bags from the spindles.

FIG. 5 shows the removal operation of the ready formed bags S from the spindle M.

It is possible to notice that the spindles are hollow so that the vertical shaft H can run along the vertical direction inside them. The shaft H runs accordingly from bottom to top and vice versa.

In the example shown in FIG. 5, the vertical motion of the shaft is actuated by means of a shaped groove K placed on the fixed cam D of the carousel G. In particular the lower extremity of the shafts H running inside the spindles M is properly constrained to move along the shaped groove K placed on the fixed cam D. The shaped groove K is continuous and is placed along the entire perimeter of the cam D at several heights. In particular, as can be seen in FIG. 5, in the region on the right in the figure, the shaped groove K runs along the lower part of the perimeter of the cam. On the contrary, in the region on the left in the figure, the shaped groove K runs along the higher part of the perimeter of the cam D. In this way, since the lower extremities of the shafts H are constrained to move along the shaped groove K, the shafts H move from top to bottom and vice versa when the carousel, and accordingly the spindles M with the shafts H, rotate with respect to the cam D. This allows the progressive removal of the bags S from the spindles M during the rotation of the carousel G. The progressive removal of the bags from the spindles M during the rotation of the carousel G allows the reduction of the probability of breaking the bags in this phase of the production.

The shafts H are provided on the top with a support X which thus moves together with the shaft H and is accordingly actuated by the groove K of the fixed cylindrical cam D during the rotation of the carousel G. The support X is thus adapted to push the bag S upwards removing it from the spindle M. The support X comprises a first surface I and a second surface L. The first surface I is horizontal and the second surface L is vertical. Furthermore, the two surfaces I and L are adjacent so as to form an edge in correspondence of an angle of 90°. The first surface I is adapted to support the bottom of the bags S. In particular, when the shaft H raises, the surface I pushes against the inner wall of the bottom of the bags S lifting them and thus removing them from the spindles M. The surface I may for instance have an area substantially corresponding to the area of the upper surface of the spindle and thus substantially corresponding to the area of the bottom of the bags S. In this way, a uniform pressure is applied on the bottom of the bags S minimizing the risk of breaking them during the removal from the spindles M.

As will be better described below, the second surface L of the support X is adapted to cooperate with the collecting means in the collecting phase of the bags S from the spindles M.

FIG. 5 further schematically displays several phases of the formation of bags S simultaneously occurring at the positions where the spindles M placed along the perimeter of the carousel G are located.

In particular, it is possible to see the sheet E comprising the cuts J defining the flaps of the bottom of the bags not yet folded and placed in contact with one of the spindles M at a first position. The upper side of the sheet E is placed at higher level than the upper surface of the spindle M so as to allow the formation of the bottom of the bag S.

In the next position in the clockwise direction, the sheet E is folded around the spindle M.

In the next position in the clockwise direction, it is schematically shown that three of the four flaps forming the bottom of the bag S are folded while a fourth flap must still be folded.

In the next positions in the clockwise direction, the bag is gradually lifted by means of the shafts H and of the shaped groove K until it is completely removed with respect to the body of the spindle M.

The operations can be simultaneously performed. In particular, since the spindles M are placed around the entire circumference of the carousel G, each of the spindles M is placed in a specific position wherein a predefined operation can be performed. Furthermore, the intermittent rotation of the carousel G allows a predefined spindle M to take all the positions schematically shown in the figure so as to guarantee not only the simultaneity of the operations, but also their continuity in time.

Figure 6:
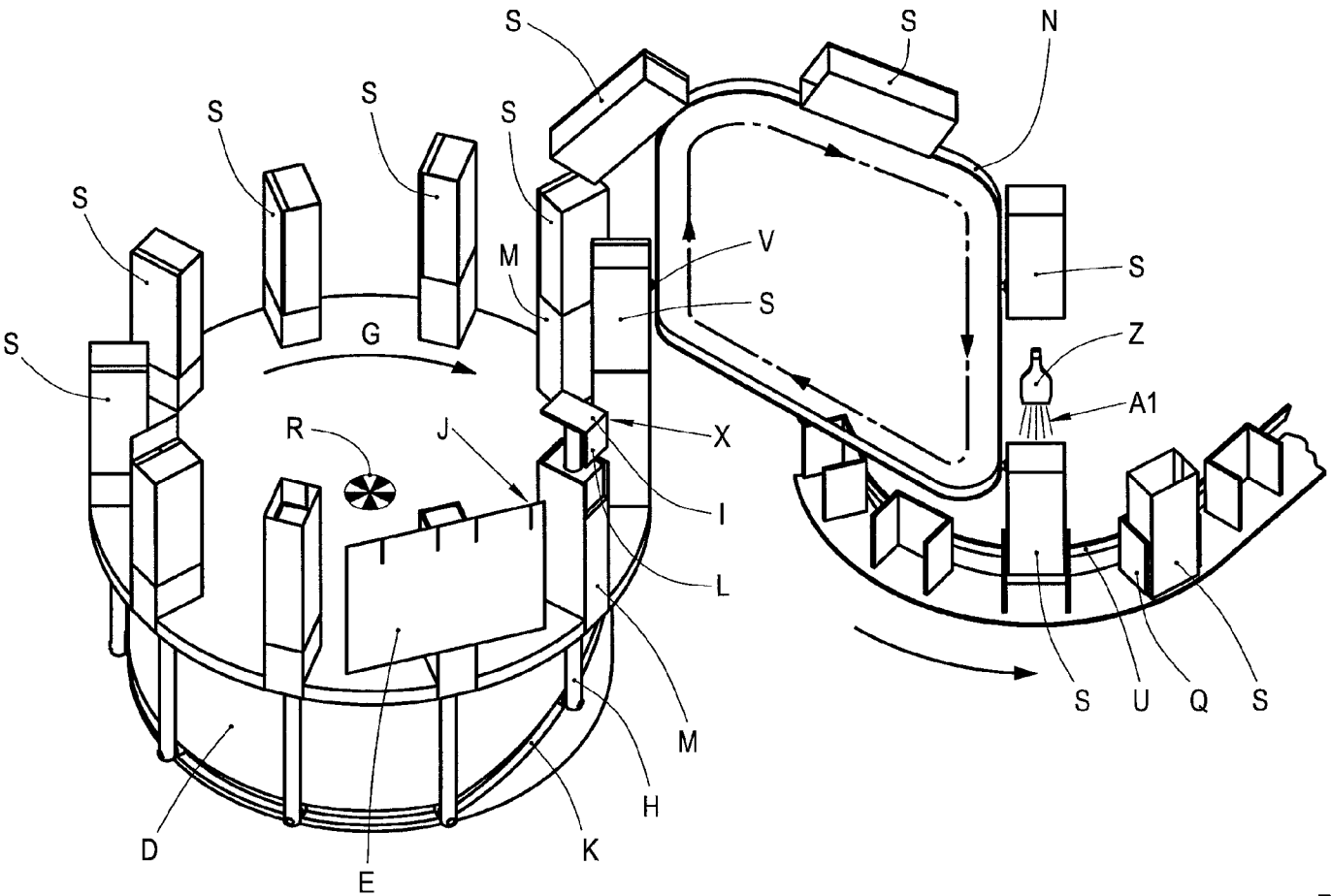
FIG. 6 schematically displays a bag packaging machine with intermittent carousel, collecting means and conveying means according to an embodiment of the present invention.

FIG. 6 schematically displays the transfer operation of the bag S from the spindle M to the container Q of the conveying means U by means of the collecting means. It is possible to notice that during the transfer the bags S are reversed and brought in proximity to the containers Q of the conveying means U with the opening facing upwards. In particular, the collecting means are adapted to collect the bags S from the spindles M and to reverse them so as to place them with the opening facing upwards and the bottom facing downwards so as to be able to subsequently perform the filling of the bags S.

The collecting means are adapted to simultaneously support a plurality of bags S so that at least some of the supported bags S are simultaneously in different phases of the reversing operation. In particular, in the example shown in FIG. 6, the collecting means support simultaneously five bags S. A first bag S is still in correspondence to the spindle M and is thus in a vertical position with the opening facing downwards and the bottom facing upwards. A second bag S is in a tilted position during the reversing. A third bag is in a substantially horizontal position during the reversing. A fourth bag is in a vertical position with the opening facing upwards and the bottom facing downwards so that the reversing is completed. A fifth bag is in proximity of the container Q of the conveying means U. The collecting means can be adapted to simultaneously support and thus reverse several numbers of bags S.

The collecting means may comprise a belt N in continuous transit whose motion is synchronized with the motion of the carousel G. The belt N may comprise holding means V adapted to support the bags S. The holding means V move thus together with the belt N in continuous transit. For example, the holding means V may comprise suction cups in communication with a suction pump as described in detailed below.

Furthermore, the collecting means shown in FIG. 6 further comprise release means adapted to release the bags placed with the opening facing upwards and with the bottom facing downwards from the collecting means. For example, the release means may comprise a nozzle Z adapted to produce an air blow A1 inside the bags S placed with the opening facing upwards and the bottom facing downwards so as to remove the bags S from the collecting means by means of the pressure applied by the air of the air blow A1 on the bottom of the bags S. The nozzle Z may be placed in a lateral position with respect to the way followed by the bags. Furthermore, the nozzle Z may be attached to the body of the packaging machine.

The system schematically shown in FIG. 6 further comprises conveying means U adapted to convey the bags placed with the opening facing upwards and the bottom facing downwards coming from the collecting means. The conveying means U may for example convey the bags S to filling stations so as to fill the bags S. Alternatively, the conveying means U may convey the bags to storing stations where several bags S are stored.

The conveying means U comprise a belt on which containers Q adapted to house the bags S are placed. In particular, in the example shown in FIG. 6, each of the containers Q is adapted to house a single bag S. It is however possible to provide alternative configurations, for instance with containers adapted to house more than one bag.

The collecting means are adapted to transfer the bags S from the carousel G to the conveying means U during the reversing procedure. In other words, the collecting means are adapted to transfer the bags S from the carousel G to the conveying means U and, at the same time, to reverse the bags S. During the transfer from the carousel G to the conveying means U, the bags are reversed. Furthermore, as can be seen in the figure, the collecting means transfer and thus reverse simultaneously a plurality of bags. The carousel G, the collecting means and the conveying means are thus properly synchronized so as to effectively cooperate as schematically shown in FIG. 6.

The collecting means may for example comprise holding means V which, in continuous transit, grab the bag S, remove it from the support X on which it is placed and, rotating it, they bring it in proximity of the containers Q with the opening facing upwards.

In the example shown in FIG. 6, the synchronization between the carousel G, the collecting means and the conveying means U is so that one of the holding means V of the collecting means is in correspondence to the spindle M of the carousel G where the shaft H is in the uppermost position of its travel range so as to collect the bag S placed on this spindle M. At the same time, a further holding mean V of the collecting means supporting a reversed bag S placed thus with the opening facing upwards and the bottom facing downwards is in correspondence to one of the containers Q of the conveying means U so as to insert this bag S in the container Q. Further holding means V of the collecting means support further bags S in several phases of the reversing procedure.

The motion of the belt N of the collecting means may be a continuous motion synchronized both with the alternate motion of the carousel G intermittently rotating, and with the alternate motion of the conveying means U. In particular, the conveying means U may be subject to an alternate motion wherein a stop is provided for the containers Q in correspondence to the place where the bag S is released from the collecting means by means of the release means. The release means may be thus adapted to release the bags in phase with the positioning of the containers Q of the conveying means U in alternate transit. The synchronization of the motion of the belt N in continuous transit with the carousel G intermittently rotating and with the conveying means in alternate transit allows the optimization of the production times of the bags and the efficient integration of the different phases of the production of the bags by the machine.

In the example shown in FIG. 6, the collecting means are further adapted to collect the bags from the spindles M when the shaft H is placed in the uppermost position of its travel range. In other words, the collecting means collect the bags S from the spindles M when the bags are removed from the spindles M by means of the upward motion of the shaft H.

FIGS. 7 to 13 schematically display several phases of the operations performed by means of the collecting means. In particular, FIGS. 7 to 13 show how the holding of the bag S by means of the suction cup is performed and the path followed by the bag S for entering reversed into the container Q of the conveying means U.

As simplifying example, a single holding mean V comprising a suction cup is considered. However, the holding means V can be numerous, all of them supported by the belt N of the collecting means in continuous transit.

Figure 7:
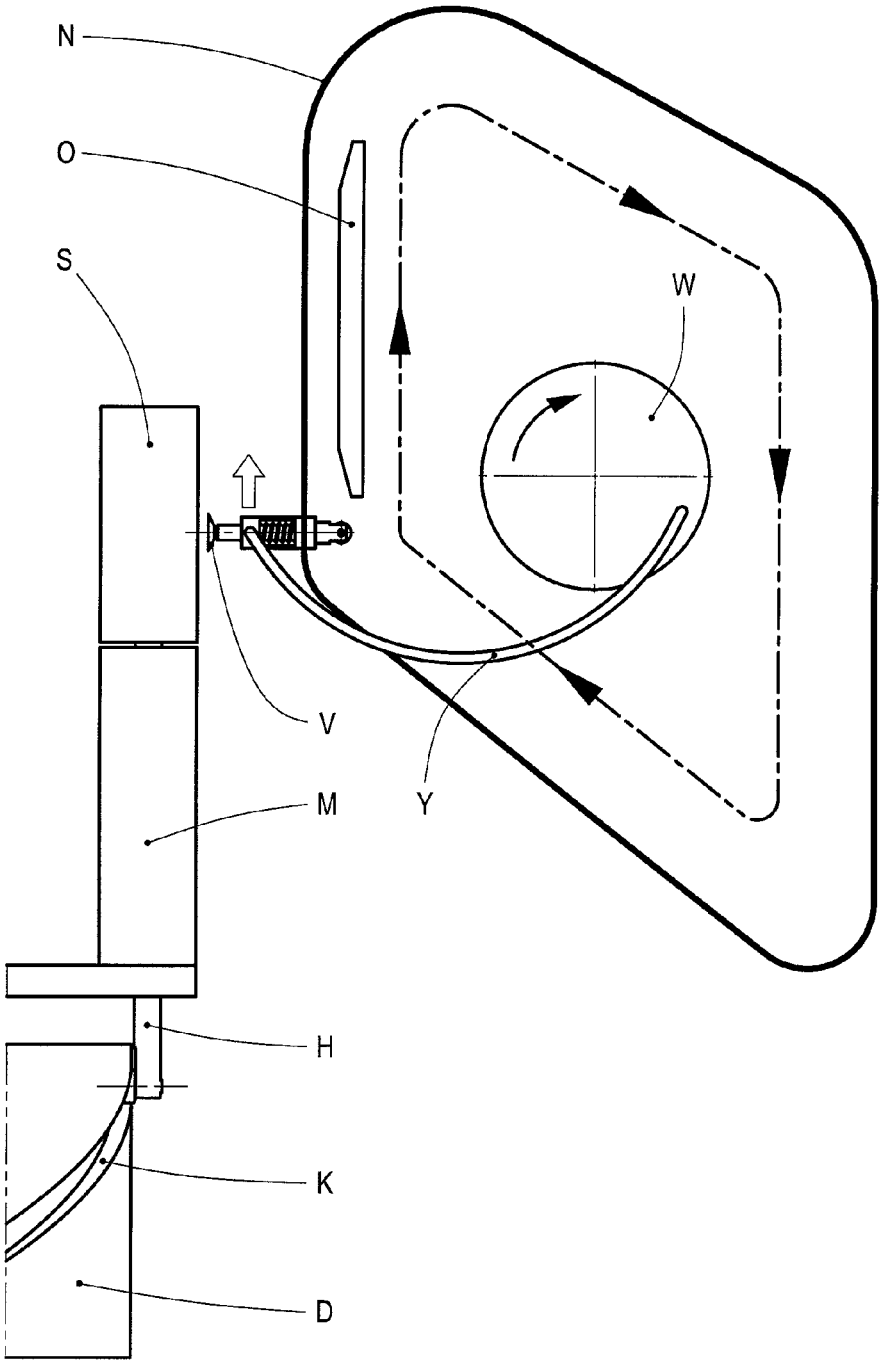
FIG. 7 schematically displays a phase of the collection of a bag from a spindle according to an embodiment of the present invention.

FIG. 7 shows the forward motion of the suction cup toward the holding point placed in proximity of the bottom of the bag S. It is possible to see that the suction cup is far from the wall of the bag and the shaft H is at the upper end of its travel range. It is also possible to see that the bag S is completely removed from the body of the spindle M and is supported by the support X placed at the upper extremity of the shaft H. The support X is not visible in FIG. 7 because it is located inside the bag S.

The suction cup is in communication with a valve disc W by means of a pipe Y. The valve disc W connects therefore the suction cup with a suction pump.

Figure 8:
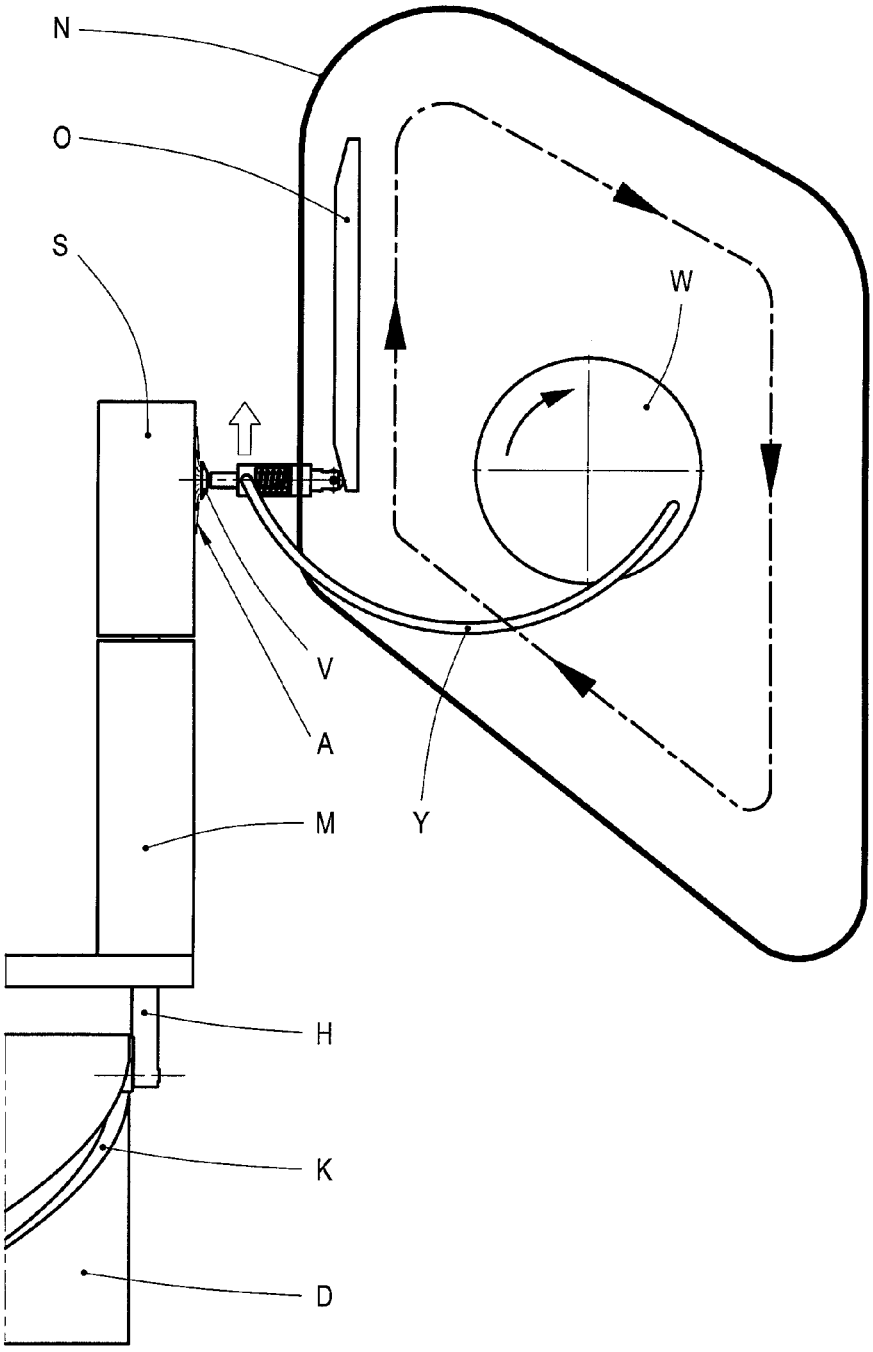
FIG. 8 schematically displays a further phase of the collection of a bag from a spindle according to an embodiment of the present invention.

FIG. 8 shows the approaching of the suction cup to the holding point.

It is possible to see that the suction cup is sucking in thanks to the action of the suction pump. In particular, the symbol A in the drawing refers to the air which is sucked in by the suction cup creating the vacuum by means of which the suction cup grabs and holds the bag. Moreover, it is possible to see that the valve disc W connecting the suction cups with the suction pump follows in its rotation the suction cup to which it is connected by means of the pipe Y.

Figure 9:
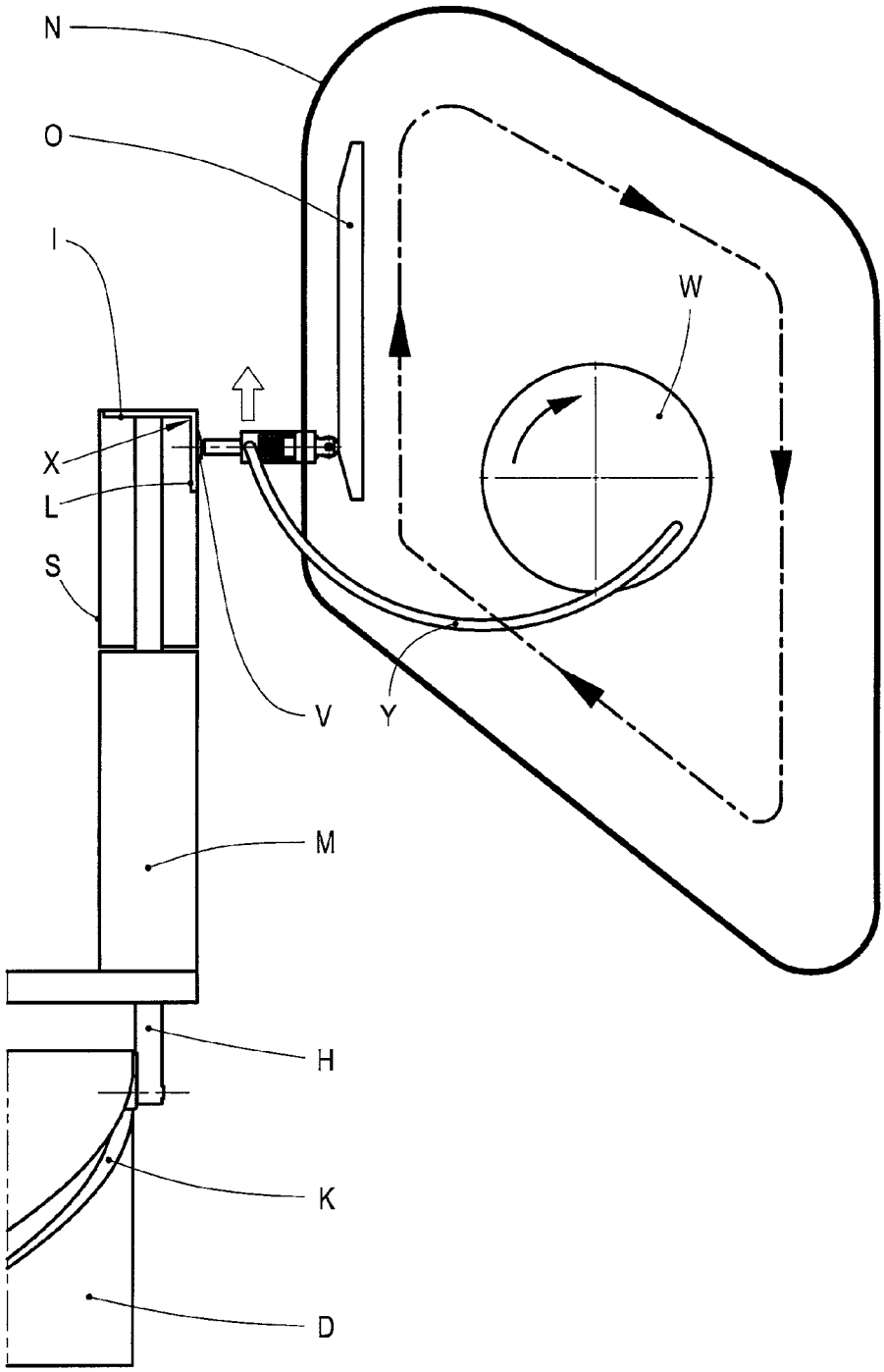
FIG. 9 schematically displays a further phase of the collection of a bag from a spindle according to an embodiment of the present invention.

FIG. 9 shows the phase in which the suction cup grabs the bag S which, in this figure, is shown in cross section.

It is possible to see that, once the suction cup in continuous transit has reached the holding point, it is pushed by the protrusion O against the wall of the bag S which is in turn counter pushed from the inside by the vertical surface L of the support X. In particular, the collecting means comprise a protrusion O adapted to push the suction cup against the wall of the bag S and to keep it in that position until the bag has been completely removed from the support X.

Since the support X comprises the vertical surface L exerting a counter pressure against the thrust of the suction cup, the risk of damaging the bags because of the action of the suction cup is minimized. Moreover, the counter pressure exerted by the vertical surface L renders the grabbing of the bag by means of the suction cup easier. In particular, the wall of the bag is placed between the vertical surface L and the suction cup so that the vertical surface L is in contact with the inner surface of the wall of the bag while the suction cup exerts its grabbing action on the outer surface of the wall of the bag. The stiffness guaranteed by the presence of the vertical surface L of the support X in the region in correspondence to the suction cup renders the grabbing of the bag by the suction cup easier.

Figure 10:
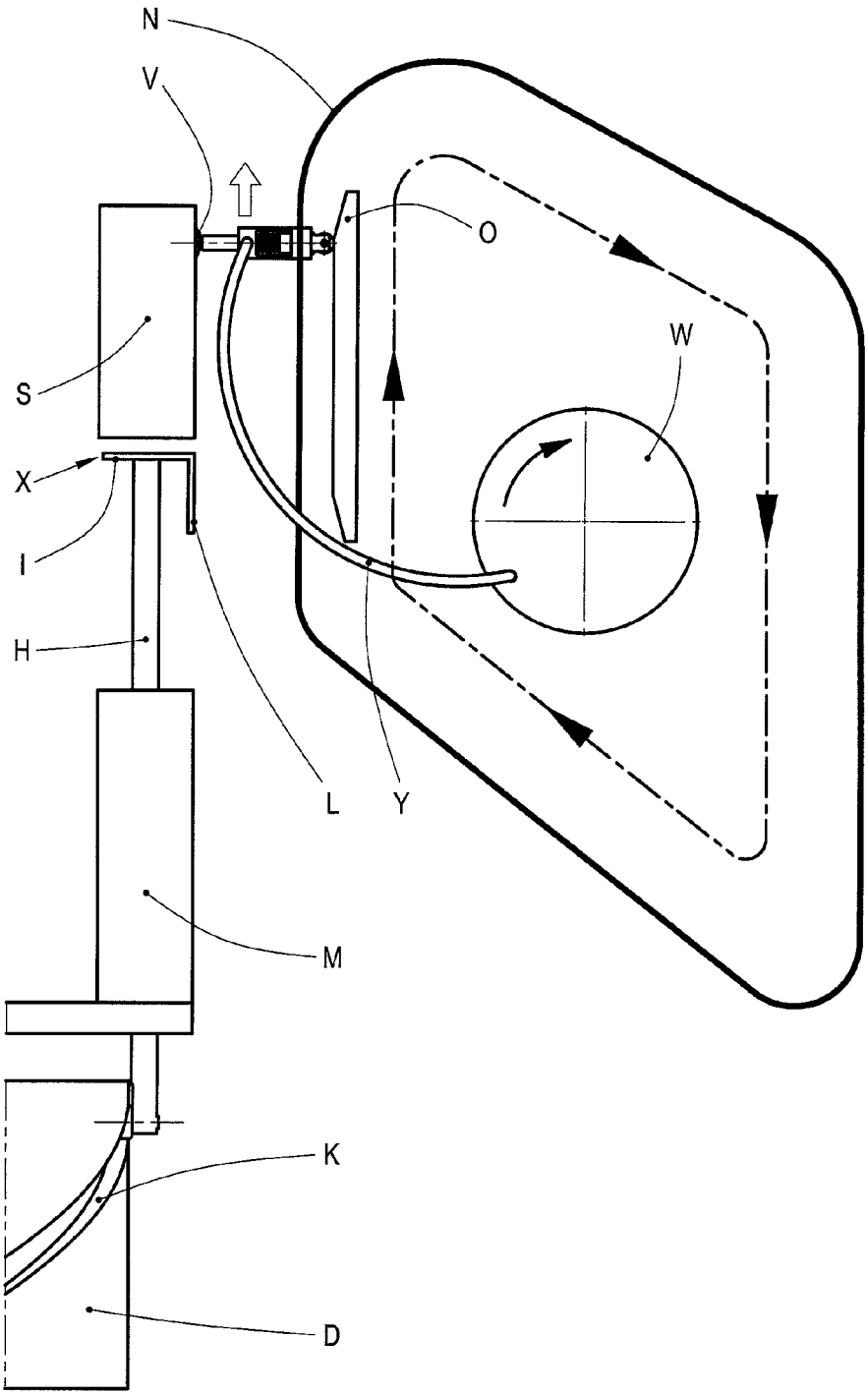
FIG. 10 schematically displays a further phase of the collection of a bag from a spindle according to an embodiment of the present invention.

FIG. 10 shows the complete removal of the bag S, moving together with the suction cup, from the support X during the continuous transit of the suction cup. It is possible to see the shaft H and the surfaces I and L of the support X since they are no longer hidden by the bag S. Furthermore, it is possible to see that the suction cup has reached the end of its travel range along the protrusion O. In practice, the bag is attached to the suction cup and it moves together with it so as to follow the motion of the suction cup. The motion of the suction cup is such that the bag is removed from the shaft H and from the support X.

Figure 11:
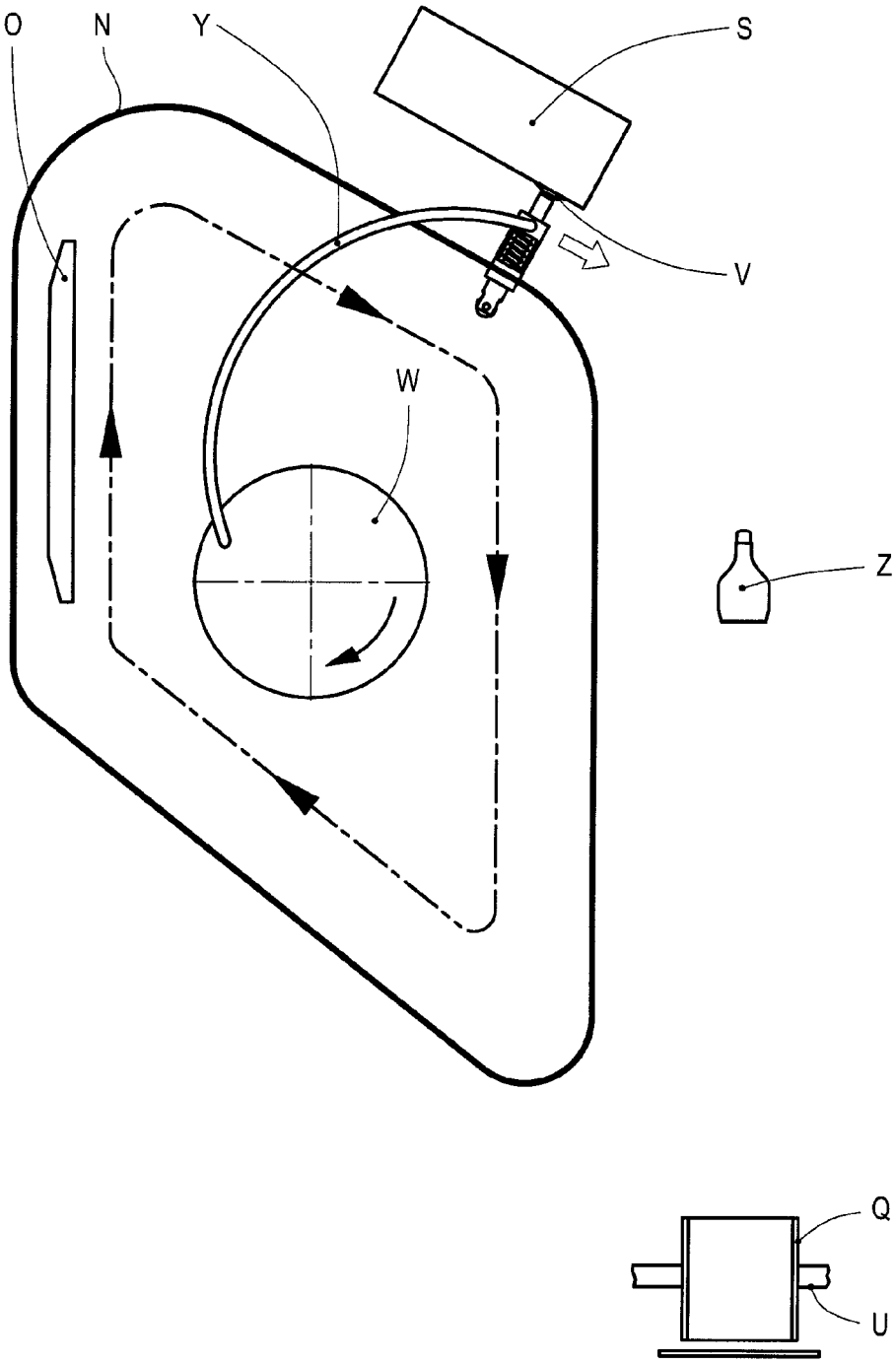
FIG. 11 schematically displays a phase of the reversing process of a bag according to an embodiment of the present invention.

FIG. 11 schematically displays a phase of the reversing of the bag. In particular, FIG. 11 shows the advancement of the bag S moving with the suction cup in continuous transit by means of the belt N of the collecting means toward the container Q of the conveying means and the concurrent reversing of the bag. The bag shown in FIG. 11 is partially reversed. In particular, the bag S is in an intermediate position between the position with the opening facing downwards and the bottom facing upwards and the position with the opening facing upwards and the bottom facing downwards.

Moreover, it is possible to see the nozzle Z attached to the body of the machine.

Figure 12:
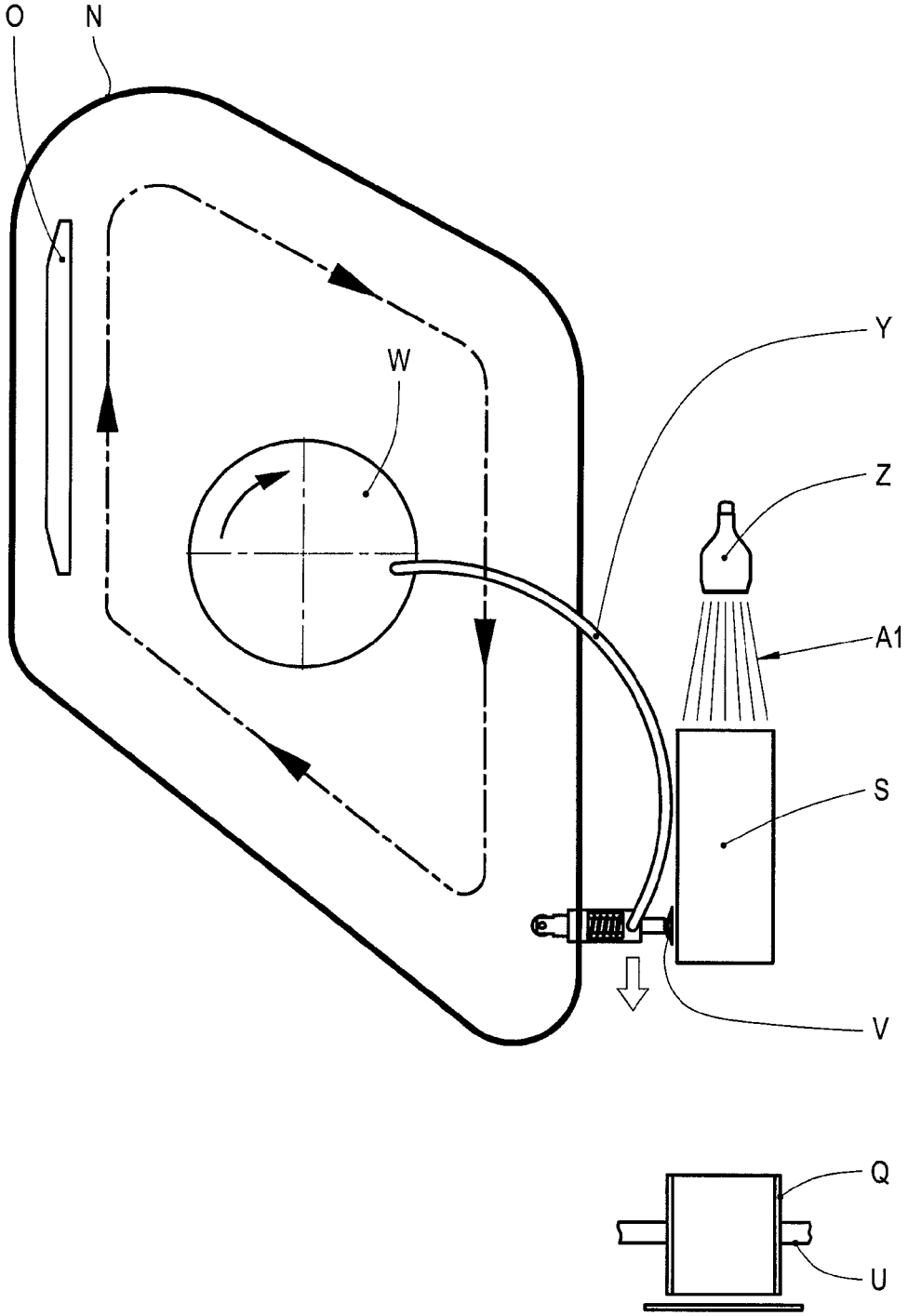
FIG. 12 schematically displays a phase of the release of a bag from the collecting means according to an embodiment of the present invention.

FIG. 12 displays the phase in which the suction cup leaves the bag S. For example, in order to let the suction cup release the bag S, it is possible to interrupt the connection between the suction pump and the suction cup. The interruption of the connection between the suction cup and the pump may be performed by means of the valve disc W. Moreover, in order to further accelerate the release, it is possible to connect the suction cup with the atmospheric pressure of the environment surrounding the machine. The valve disc W may be thus adapted to alternatively connect the suction cup to the suction pump or to the atmospheric pressure. When the bag S is completely reversed and is in proximity of the container Q of the conveying means U, it is possible to interrupt the connection between the suction cup and the suction pump and to open the connection between the suction cup and the atmospheric pressure so that the suction cup detaches from the bag S.

Furthermore, it is possible to notice that the bag S is hit by a blow of air A1 coming from the nozzle Z. The blow of air A1 allows the efficient removal of the bag S from the collecting means minimizing at the same time the risk of damaging them during this operation. Furthermore, the blow of air A1 allows the precise directing of the bag S toward the container Q of the conveying means.

The blow of air A1 can be actuated for example by means of an electro valve. Moreover, the blow of air A1 can be synchronized with the detachment of the suction cup from the bag S. In particular, the electro valve actuating the blow of air A1 may be adapted to actuate the blow of air A1 immediately after the suction cup is detached from the bag S. For example, the blow of air A1 may be actuated immediately after the connection between the suction cup and the suction pump is interrupted. The blow of air A1 may also be actuated immediately after the suction cup is put in communication with the atmospheric pressure.

Figure 13:
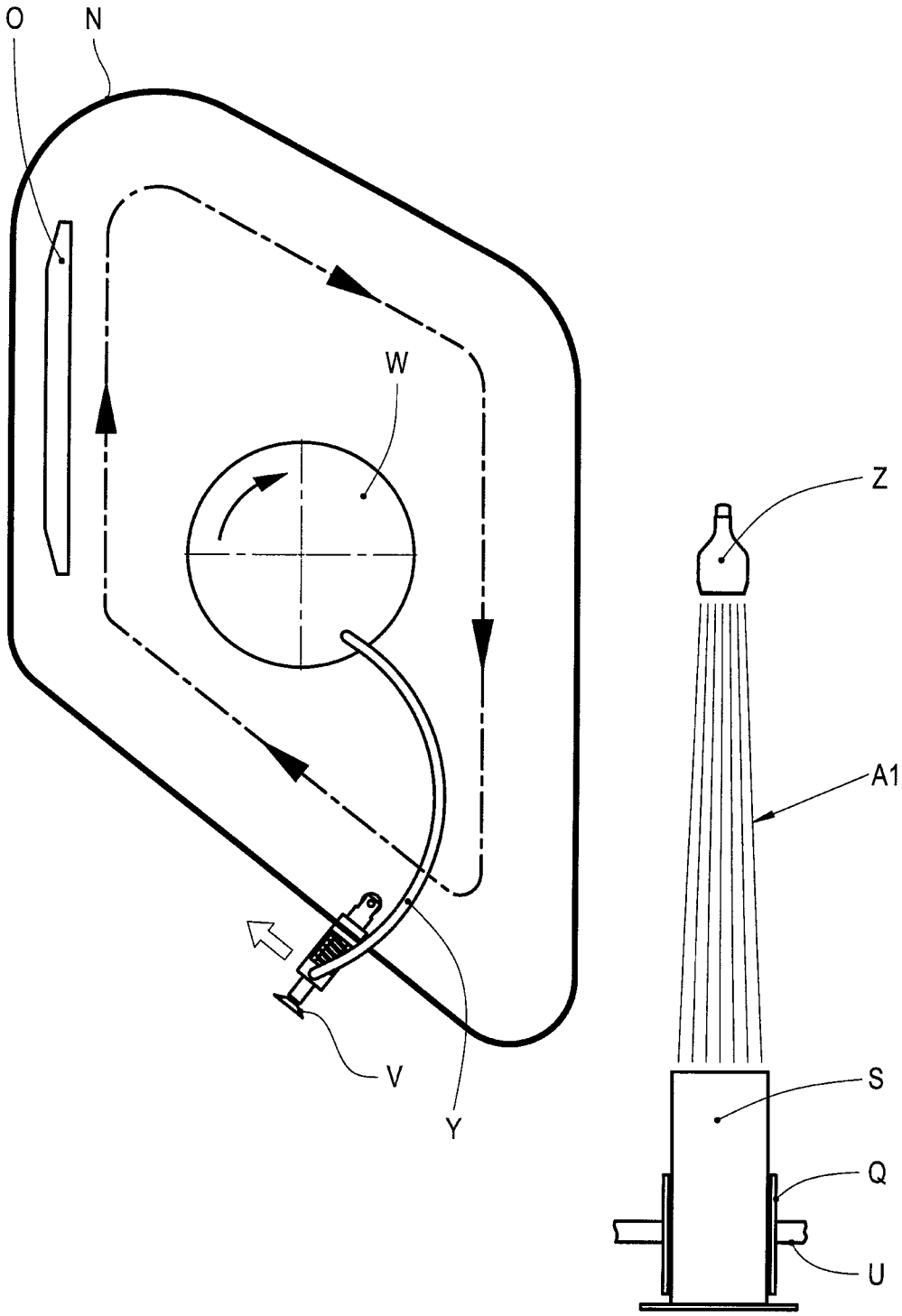
FIG. 13 schematically displays a further phase of the release of a bag from the collecting means according to an embodiment of the present invention.

FIG. 13 shows the phase in which the bag S, pushed by the blow A1, enters into the container Q. It is possible to see that the suction cup and the valve disc W carry on in continuous transit along their path.

In the previous figures it is possible to observe that the bags are realized with the bottom facing upwards and this new aspect of the spindles oriented upward allows a general optimization of the entire functional architecture of the machine. For example, this arrangement guarantees the presence of a large space in proximity of the spindles. In this way, the cutters C, the folding devices T1, T2, T3, T4 and the vertical press devices P1, P2, P3, P4 forming and stabilizing the bottom of the bag facing upwards can be easily integrated into the system. Furthermore, this improves the accessibility of the operator to the region of the spindles, for example for maintenance operations on the machine.

Even if the present invention has been explained with reference to the embodiments described above, it is clear for the skilled person that it is possible to realize several modifications, variations and improvements of the present invention in the light of the teaching described above and in the ambit of the appended claims without departing from the spirit and the scope of protection of the invention.

For example, the collecting means may be structured in such a way so as to collect and reverse simultaneously several numbers of bags. Furthermore, the carousel G may be provided with several numbers of spindles. Moreover, the folding devices may be placed and structured in such a way so as to form several kinds of bottoms of the bag. The number of vertical press devices may be varied too, and the system may comprise one or more vertical press devices. Moreover, the fixed plate F may occupy an arc having several lengths.

In addition, those areas in which it is believed that those of ordinary skill in the art are familiar, have not been described herein in order not to unnecessarily obscure the invention described.

Accordingly, the invention is not limited to the specific embodiments described above, but it is only limited by the scope of protection of the appended claims.

REFERENCE SIGNS

In the appended figures, the features of the system are marked as follows:

"A" refers to the air sucked in through the suction cup creating the vacuum by means of which the suction cup grabs and holds the bag;

"A1" refers to the air blow pushing the bag into the container;

"B" refers to the reel from which the sheets, which form the bag by surrounding the spindle, are cut;

"C" refers to the cutter cutting the sheets from the reel;

"D" refers to the fixed cylindrical cam;

"E" refers to the sheet which, folded around the spindle, forms the bag;

"F" refers to the upper fixed plate which completes the formation of the bottom of the bag;

"G" refers to the intermittent horizontal carousel;

"H" refers to the shaft pushing upwards the bag removing it from the body of the spindle;

"I" refers to the horizontal surface of the support on which the bag is supported when it is pushed during the removal;

"J" refers to the cuts formed on the sheet and allowing the formation of the bottom of the bag;

"K" refers to a shaped groove along which the shafts, which push the bags upwards removing them from the spindles, operate;

"L" refers to the vertical surface of the support against which the suction cup pushes in order to grab the bag;

"M" refers to the vertical spindle, from bottom to top, around which the sheets are folded in order to form the bag;

"N" refers to a belt in continuous transit supporting the suction cups of the collecting means;

"O" refers to the protrusion pushing the suction cups against the bags;

"P" refers to the vertical press devices which, pushing against the upper part of the spindle, stabilize the bottom of the bag;

"Q" refers to the container housing the bag with the opening facing upwards;

"R" refers to the centre of the intermittent carousel with spindles;

"S" refers to the bag formed around the spindles;

"T" refers to the folding devices forming the bottom of the bag;

"U" refers to the conveying means that may comprise containers "Q" conveying the bags once they are reversed, i.e. when they are placed with the opening facing upwards and the bottom facing downwards;

"V" refers to the holding means that may comprise for example suction cups;

"W" refers to the valve disc connecting the suction cups with the suction pump or with the atmospheric pressure;

"X" refers to the support comprising the horizontal surface lifting the bag and the vertical surface contrasting the suction cups;

"Y" refers to the pipe connecting the valve disc to the suction cups;

"Z" refers to a nozzle blowing air inside the bag pushing it inside the container.

What is claimed is:

1. Bag packaging machine with a horizontal carousel having rotary motion comprising:

vertical spindles fastened to the horizontal carousel and facing upwards so as to allow the realization of bags having an opening facing downwards and a bottom facing upwards, the vertical spindles extending parallel to the axis of rotation of the horizontal carousel, collecting means adapted to collect said bags from said spindles and to reverse said bags so as to place them with the opening facing upwards and the bottom facing downwards so as to be able to perform filling of said bags.

2. Bag packaging machine according to claim 1, wherein said collecting means are adapted to simultaneously support a plurality of bags so that at least some of the supported bags are simultaneously in different phases of the reversing operation.

3. Bag packaging machine according to claim 1, wherein said collecting means comprise a belt in continuous transit whose motion is synchronized with the motion of said carousel, said belt comprising holding means adapted to support said bags.

4. Bag packaging machine according to claim 3, wherein said holding means comprise suction cups, said suction cups being in communication with a suction pump.

5. Bag packaging machine according to claim 4, further comprising means for alternately connecting said suction cups to the suction pump or to atmospheric pressure.

6. Bag packaging machine according to claim 1, wherein said collecting means further comprise releasing means adapted to release the bags placed with the opening facing upwards and the bottom facing downwards from said collecting means.

7. Bag packaging machine according to claim 6, wherein said releasing means comprise a nozzle adapted to produce an air flow inside said bags placed with the opening facing upwards and the bottom facing downwards so as to remove said bags from said collecting means.

8. Bag packaging machine according to claim 1, further comprising conveying means adapted to convey said bags placed with the opening facing upwards and the bottom facing downwards, said collecting means being adapted to transfer said bags from said carousel to said conveying means during the reversing procedure.

9. Bag packaging machine according to claim 1, wherein the vertical spindles are hollow and a vertically reciprocating shaft runs along the vertical direction inside the hollow spindles so that vertical motion of said shaft allows removing upwards at least partially the bags formed on the spindles.

10. Bag packaging machine according to claim 9, wherein the vertical motion of said shaft is actuated by means of a shaped groove placed on a fixed cam of said carousel so that said shaft runs along the vertical direction as a consequence of the rotation of said carousel.

11. Bag packaging machine according to claim 9, wherein an upper portion of said shaft is provided with a support comprising a first horizontal surface adapted to support the bottom of said bags and a second vertical surface adapted to cooperate with said collecting means in a collecting phase of said bags from said spindles.

12. Bag packaging machine according to claim 9, wherein said collecting means are adapted to collect said bags from said spindles when said shaft is placed in the uppermost position of its travel range.

13. Bag packaging machine according to claim 1, further comprising means for placing an unfolded sheet on at least one of the vertical spindles, which is cut from a feeding reel and properly provided with cuts, with an upper side of the sheet above an upper surface of the at least one vertical spindle so as to allow for the formation of the bottom of the bag.

14. Bag packaging machine according to claim 1, further comprising folding devices for forming four flaps of the bottom of the bag, said folding devices being placed so as to be in correspondence of at least one of said spindles so that a first folding device and a second folding device are opposed with respect to the at least one spindle along a radial direction of said carousel and so that a third folding device and a fourth folding device are opposed with respect to the at least one spindle along a direction substantially perpendicular with respect to the direction defined by said first folding device and said second folding device.

15. Bag packaging machine according to claim 1, further comprising one or more vertical press devices placed above the vertical spindles, said vertical press devices being adapted to stabilize the bottom of said bags contrasting with an upper surface of said spindles.

16. Bag packaging machine according to claim 1, further comprising an upper fixed plate placed above said spindles along at least a portion of a perimeter of said carousel so as to stabilize the bottom of the bags during the rotation of said carousel.

17. Bag packaging machine according to claim 16, wherein said fixed plate comprises openings corresponding to an upper portion of said spindles, each of said openings being adapted to house at least a vertical press device so as to stabilize the bottom of the bags placed on the spindles in correspondence to said openings.

18. A bag forming and packaging machine comprising:

a first carousel having a plurality of spindles with a distal end facing upward and spaced along the perimeter of said first carousel;

means, associated with said first carousel, for forming a bag on each of said plurality of spindles from a sheet material;

a bottom folding device forming a bag bottom on the distal end of each of said plurality of spindles;

a second carousel having a plurality of bag containers with an opening facing upward;

transit means, positioned between said first carousel and said second carousel, for transporting the bag formed on each of said plurality of spindles of said first carousel to each of the plurality of bag containers on said second carousel and reversing the orientation of the bag wherein the bag bottom is placed in one of said plurality of bag containers with the bag bottom adjacent said second carousel, whereby an open end of the bag is facing upward facilitating filling of the bag.

19. A bag forming and packaging machine as in claim 18 further comprising:

a support reciprocally mounted on each of said plurality of spindles, said support having a vertical and horizontal surface mounted on a shaft;

a shaped groove formed on a cylindrical cam attached to said first carousel and coupled to one end of said shaft, wherein said shaft reciprocates during rotation of said first carousel, whereby said support pushes the bag upwards facilitating removal from each of said plurality of spindles.

20. A bag packaging machine comprising:

a horizontal carousel having a planar surface and a perimeter;

a plurality of vertical spindles extending perpendicularly from the planar surface of said horizontal carousel with a distal end facing upward and spaced along the perimeter of said horizontal carousel;

a plurality of shafts, one each of said plurality of shafts associated with one of said plurality of vertical spindles, wherein each of said plurality of shafts moves in an upward motion allowing removing upwards of a bag having an opening and a closed bottom, with the opening placed over each of said plurality of vertical spindles and with the closed bottom facing upwards; and collecting means, positioned adjacent said horizontal carousel, for removing the bag from each of said plurality of vertical spindles and reversing the orientation of the bag wherein the opening is facing upwards and the closed bottom is facing downwards, whereby the opening of the bag is facing upward facilitating filling of the bag.

* * * * *